US005150396A

United States Patent [19]

Snoeren et al.

[11] Patent Number: 5,150,396

[45] Date of Patent: Sep. 22, 1992

[54] X-RAY EXAMINATION APPARATUS COMPRISING AN X-RAY IMAGE INTENSIFIER TUBE

[75] Inventors: Rudolph M. Snoeren, Eindhoven; Johannes W. J. M. Scheuermann, Heerlen, both of Netherlands

[73] Assignee: U.S. Philips Corporation, New York, N.Y.

[21] Appl. No.: 734,831

[22] Filed: Jul. 24, 1991

[30] Foreign Application Priority Data

Jul. 25, 1990 [NL] Netherlands ..... 9001687

[51] Int. Cl.[5] ..... H05G 1/64

[52] U.S. Cl. ..... 378/99; 358/111

[58] Field of Search ..... 378/99; 358/111

[56] References Cited

U.S. PATENT DOCUMENTS 4,220,890 9/1980 Beekmans .

4,809,309 2/1989 Beekmans .

4,833,625 5/1989 Fisher et al. ..... 358/111

FOREIGN PATENT DOCUMENTS 1470889 4/1977 United Kingdom .

*Primary Examiner*—Craig E. Church

*Attorney, Agent, or Firm*—William Squire

[57] ABSTRACT

The X-ray examination apparatus (1) comprises an X-ray image intensifier tube (19) having an entrance screen (21), an exit section (24) having an exit screen (25) and an exit window (27), an optical imaging system (32) and a photosensitive detection device (41). The exit section (24) comprises a fibre optical plate. Between the fibre optical plate and the optical imaging system (32) there is quartz birefringent crystal element (31) which selectively increases the optical spatial frequency of the image processed thereby in order to correct for image aberrations introduced by the fibre optical plate structure.

16 Claims, 1 Drawing Sheet

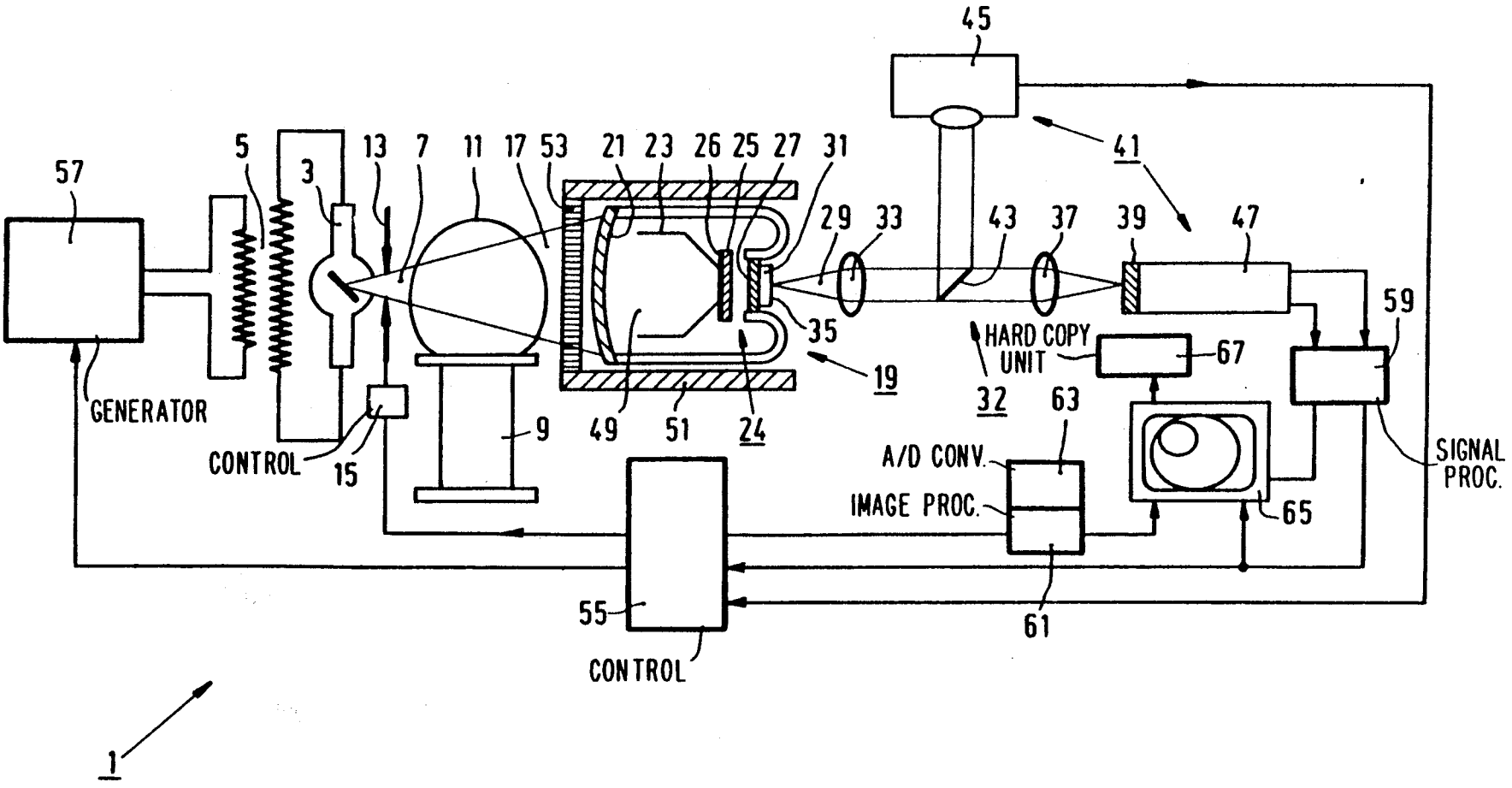
SIGNAL PROC.
59
65
47
67
41
39
HARD COPY UNIT
32
37
63
61
45
43
A/D CONV.
IMAGE PROC.
33
19
31
29
35
27
24
25
26
51
23
21
49
CONTROL
55
53
17
9
11
7
13
15
3
CONTROL
5
GENERATOR
57
1

X-RAY EXAMINATION APPARATUS COMPRISING AN X-RAY IMAGE INTENSIFIER TUBE

FIELD OF THE INVENTION

The invention relates to an X-ray examination apparatus, comprising an X-ray image intensifier tube having an entrance screen, an exit section comprising an exit screen and an exit window, an optical imaging system and a photosensitive detection device.

BACKGROUND OF THE INVENTION

An X-ray examination apparatus of this kind is known from the Patent Specification U.S. Pat. No. 4,809,309.

In an apparatus described therein the light beam generated in the exit screen emanates from the X-ray image intensifier tube via an exit window. Due to repeated reflections at surfaces of the exit window, a light spot incident on the exit window is imaged, after passage through the window, as a light spot having a halo by the imaging system. This results in a mediocre image quality.

SUMMARY OF THE INVENTION

It is an object of the invention to reduce the loss of image quality in the exit section of the X-ray image intensifier tube. To achieve this, the invention is characterized in that the exit section comprises a fibre optical plate and in that an element which selectively increases the spatial frequency is arranged between the fibre optical plate and the optical imaging system. The use of a fibre optical plate prevents or at least reduces halation. In a fibre optical plate light is guided through a fibre and remains within the relevant fibre also in the case of reflection at the exit surface, thus avoiding halation. In combination with a fibre optical plate, use is made of an element which selectively increases the spatial frequency so that the information concerning the optical fibre plate structure, present in the output signal, is separated from image information of an object to be examined. This is because the information of the fibre optical plate structure present in the light beam, in conjunction with an optical imaging system succeeding the X-ray image intensifier tube, is liable to give rise to a ring pattern in the image formed.

It is to be noted that a fibre optical plate is known per se from GB 1,470,889.

A preferred embodiment of the X-ray examination apparatus in accordance with the invention is characterized in that the element which selectively increases the spatial frequency is a birefringent crystal. An optimum effect can be achieved by cutting slices from a crystal along planes extending parallel to two crystal axes of different length which determine the degree of birefringence. The fibre optical plate information present in the output signal may be considered to be a periodically undesirable signal. When frequency doubling is applied to such a signal, it will be placed beyond the resolving power of the optical imaging system. The occurrence of distrubing line patterns due to image field curvature of the imaging system is thus prevented upon formation of a light optical image.

A further preferred embodiment of the X-ray examination apparatus in accordance with the invention is characterized in that the birefringent crystal is a quartz crystal. Because the conventional exit section now comprises a fibre optical plate, a difference in optical path length is created between the exit section and the optical imaging system. This difference in optical path length, however, can be exactly compensated for by a quartz crystal. This is because the necessary thickness of the quartz crystal suitably corresponds to the thickness necessary for achieving the desirable shift by birefringence. Moreover, quartz is a material that can be comparatively readily produced and processed.

A further preferred embodiment of an X-ray examination apparatus in accordance with the invention is characterized in that the element which selectively increases the spatial frequency is arranged against the exit window. If desirable, a side of the element which selectively increases the spatial frequency which is remote from the fibre optical plate can be provided with an anti-reflection layer. Optical aberrations are thus prevented.

Another preferred embodiment of the X-ray examination apparatus in accordance with the invention is characterized in that crystal axes of the birefringent crystal which are of relevance for birefringence extend at an angle of approximately 45° with respect to an orthogonal fibre structure of the optical fibre plate. Thus, for both mutually perpendicularly oriented lines of the fibre optical plate structure an approximately equal shift occurs, so that frequency doubling is achieved in both directions.

Another preferred embodiment of the X-ray examination apparatus in accordance with the invention is characterized in that the photosensitive detection device is a ciné recording device. Due to the non-linearity of the intensification of contrast of the film, a difference arises between the density on the recording and the contrast in the recorded image. As a result of the use of a frequency-increasing element, devices for which the directional coefficient of the gamma curve deviates from 1 can now also be used for optical detection.

An alternative version of the latter preferred embodiment of the X-ray examination apparatus in accordance with the invention is characterized in that the photosensitive detection device is a television camera tube. For a camera tube the directional coefficient of the gamma curve may be approximately equal to 1, but camera tubes having a different directional coefficient are also known.

An alternative preferred embodiment of the X-ray examination apparatus in accordance with the invention is characterized in that the photosensitive detection device is a CCD matrix.

A further preferred embodiment of the X-ray examination apparatus in accordance with the invention is characterized in that the birefringent crystal is arranged at an angle of approximately 45° with respect to the fibre optical plate structure between the fibre optical plate and the CCD matrix which are arranged at an angle of approximately 45° with respect to one another.

For a CCD matrix the directional coefficient may be equal to or slightly smaller than 1, so that the image is less susceptible to undesirable density patterns stemming from the optical fibre plate structure. The use of a birefringent crystal, however, is still attractive because it can also prevent the occurrence of moiré patterns which generally become manifest during the imaging of a regular structure on a detection device having a regular structure.

BRIEF DESCRIPTION OF THE DRAWING

The invention will be described in detail hereinafter with reference to the drawing. The sole Figure of the drawing shows an embodiment of an X-ray examination apparatus in accordance with the invention.

DESCRIPTION OF THE PREFERRED EMBODIMENT

An X-ray apparatus 1 as shown in the Figure comprises an X-ray tube 3 with a power supply source 5 for generating an X-ray beam 7 for irradiating an object 11 arranged on a carrier 9. The X-ray examination apparatus 1 furthermore comprises an X-ray diaphragm device 13 with a control mechanism 15 for automatic adaptation of the desirable amount of X-rays for imaging. The X-ray beam 17 emanating from the object 11 is intercepted by an X-ray image intensifier tube 19 having an entrance screen 21, an electron optical system 23 and an exit section 24 which comprises an exit screen 25, provided with an exit phosphor layer 26, and an exit window 27. The light beam 29 generated in the exit screen 25 emanates from the X-ray image intensifier tube 19 via the exit window 27. The exit window 27 may be constructed as a fibre optical plate which may introduce image aberrations to the image transmitted thereby. In order to separate the functions of light interception and transport of a light-optical image formed in the exit phosphor layer 26 and the vacuum bridging of the exit window 27, a fibre optical plate can also serve as a carrier for the exit phosphor layer 26 and the exit window 27 can be made of normal glass. After having passed through the fibre optical plate of window 27, the image-carrying light beam is incident on an element 31 which selectively increases the optical spatial frequency of the image processed thereby and which is arranged against the exit window 27 in the present case to prevent image aberrations introduced by the fibre optical plate. In the present embodiment the element 31 is formed by a birefringent crystal, notably a quartz crystal whose crystal axes of different length extend at an angle of 45° with respect to the orthogonal fibre structure of the fibres of the fibre optical plate of window 27. The X-ray examination apparatus 1 furthermore comprises an optical imaging system 32 which includes a first lens 33. When the exit window 27 comprises a fibre optical plate, the difference in path length thus arising can be exactly compensated for by the use of quartz for the element 31. This is because quartz produces the desired degree of shift by the birefringence at a thickness required for eliminating the difference in path length occurring. Consequently, the optical system is corrected for spherical aberration. The image focal plane of a second lens 37 coincides with the target 39 of a photosensitive detection device 41. For the selected arrangement of the lens 33 the light beam 29 generated in the exit screen 25 and emerging via the exit window 27 is a parallel beam between the lenses 33 and 37. An image transfer system 43, for example, an image splitting device, may be arranged in the beam 29 so that the information of the light beam 29 can be imaged on a ciné camera 45 as well as on a video camera 47. The video camera 47 may be, for example, a conventional television camera or a CCD camera which comprises a CCD matrix which is preferably arranged at an angle of 45° with respect to the fibre optical plate of window 27. The image transfer system 43 may be, by way of further example, a partly transparent and/or tiltable mirror. In order to prevent disturbing effects of, for example, electromagnetic fields on an electron beam 49 in tube 19 which fields images photoelectrons of the entrance screen 21 on the exit screen 25, the X-ray image intensifier tube 19 is accommodated in a housing 51 which comprises, for example a trellis-shaped entrance grid 53 which combines, for example in accordance with U.S. Pat. No. 4,220,890, the functions of scattered radiation grid and magnetic screen. The X-ray examination apparatus 1 furthermore comprises a central control device 55. The device 55 is capable of controlling a generator 57 for the X-ray tube 3, a video signal processing device 59 of the television chain of the apparatus, the ciné camera 45 and, for example a device 61 comprising an AD converter 63 for digital image processing. A monitor 65 is included for image display. Use can also be made of two monitors, a first monitor always displaying, for example the instantaneous image while the second monitor displays a processed image. An image of both monitors, but notably of the latter monitor can then be recorded in a hard-copy unit 67, if desired.

We claim:

1. An X-ray examination apparatus, comprising an X-ray image intensifier tube having an entrance screen, an exit section comprising an exit screen and an exit window, an optical imaging system and a photosensitive detection device, said exit section comprises a fibre optical plate and an element which selectively increases optical spatial frequency is between the fibre optical plate and the optical imaging system.

2. An X-ray examination apparatus as claimed in claim 1 wherein the element which selectively increases the spatial frequency is a birefringent crystal.

3. An X-ray examination apparatus as claimed in claim 2 wherein the birefringent crystal is a quartz crystal.

4. An X-ray examination apparatus as claimed in claim 1 wherein the element which selectively increases the spatial frequency is arranged against the exit window.

5. An X-ray examination apparatus as claimed in claim 2 wherein crystal axes of the birefringent crystal which are of relevance for the birefringence extend at an angle of approximately 45° with respect to an orthogonal fibre structure of the optical fibre plate.

6. An X-ray examination apparatus as claimed in claim 1 wherein the photosensitive detection device is a ciné recording device.

7. An X-ray examination apparatus as claimed in claim 1 wherein the photosensitive detection device comprises a television camera tube.

8. An X-ray examination apparatus as claimed in claim 1 wherein the photosensitive detection device comprises a CCD matrix.

9. An X-ray examination apparatus as claimed in claim 8 wherein the birefringent crystal is arranged at an angle of approximately 45° with respect to the fibre optical plate structure between the fibre optical plate and the CCD matrix which are arranged at an angle of approximately 45° with respect to one another.

10. An X-ray examination apparatus as claimed in claim 3 wherein the element which selectively increases the spatial frequency is arranged against the exit window.

11. An X-ray examination apparatus as claimed in claim 10 wherein the element which selectively increases the spatial frequency is arranged against the exit window.

12. An X-ray examination apparatus as claimed in claim 2 wherein the element which selectively increases the spatial frequency is arranged against the exit window.

13. An X-ray examination apparatus as claimed in claim 10 wherein crystal axes of the birefringent crystal which are of relevance for the birefringence extend at an angle of approximately 45° with respect to an orthogonal fibre structure of the optical fibre plate.

14. An X-ray examination apparatus as claimed in claim 12 wherein crystal axes of the birefringent crystal which are of relevance for the birefringence extend at an angle of approximately 45° with respect to an orthogonal fibre structure of the optical fibre plate.

15. An X-ray examination apparatus as claimed in claim 3 wherein the photosensitive detection device comprises a CCD matrix.

16. An X-ray examination apparatus as claimed in claim 15 wherein the birefringent crystal is arranged at an angle of approximately 45° with respect to the fibre optical plate structure between the fibre optical plate and the CCD matrix which are arranged at an angle of approximately 45° with respect to one another.

* * * * *